United States Patent [19]

Runion

[11] 4,371,764

[45] Feb. 1, 1983

[54] IGNITION CIRCUIT DEENERGIZING SPRING FOR GAS APPLIANCE VALVE-SWITCH

[75] Inventor: Cleaston L. Runion, Cleveland, Tenn.

[73] Assignee: Brown Stove Works, Inc., Cleveland, Tenn.

[21] Appl. No.: 267,747

[22] Filed: May 28, 1981

[51] Int. Cl.[3] ..... H01H 9/06

[52] U.S. Cl. ..... 200/61.86

[58] Field of Search ..... 200/61.86; 431/256

[56] References Cited

U.S. PATENT DOCUMENTS

| | | | |
|---|---|---|---|
| 1,173,851 | 2/1916 | Owen | 431/256 |
| 1,700,559 | 1/1929 | Clausing | 431/256 |
| 2,596,505 | 5/1952 | Pacifico | 200/53 |
| 2,609,870 | 9/1952 | Riebman et al. | 158/111 |
| 3,971,904 | 7/1976 | Ward | 200/6 BB |
| 4,092,085 | 5/1978 | McMaster-Christie | 200/61.86 X |
| 4,123,633 | 10/1978 | Stevens et al. | 200/61.86 |
| 4,249,047 | 2/1981 | Huff et al. | 200/61.86 |

*Primary Examiner*—J. R. Scott

*Attorney, Agent, or Firm*—Merriam, Marshall & Bicknell

[57] ABSTRACT

A turn-back spring for use with a valve-switch assembly of the type employed to control the flow of gas to the burners of a gas appliance and to energize an associated electrical ignition circuit for igniting gas flowing from the burners. The spring is mounted on the valve body of the valve-switch assembly so that one end of the spring engages a lug on the drive washer of the stem of the rotatable valve member, thereby offering increasing resistance to rotation of the valve member beyond a predetermined position corresponding to a substantially full-open position of the valve. The valve stem extends through an annular bushing which is rotatably mounted in the electrical switch of the assembly and which is effective to close the contacts of the switch when the valve member and its stem are rotated to a gas flow igniting position somewhat beyond the substantially full-open position of the valve. The spring automatically rotates the valve member back to its substantially full-open position whenever a user releases the operating knob on the outer end of the valve stem.

10 Claims, 16 Drawing Figures

IGNITION CIRCUIT DEENERGIZING SPRING FOR GAS APPLIANCE VALVE-SWITCH

BACKGROUND OF THE INVENTION

This invention relates to gas valve-switches for igniting and controlling the flow of gas to gas appliances, and more particularly relates to a spring for effecting automatic deenergization of the electrical ignition circuit of a manually ignited gas appliance after ignition has occurred.

One of the problems that has developed in gas appliances which utilize electrical ignition circuits for igniting the burner or burners of the appliance is that of premature burnout or malfunction of one or more of the components of the ignition circuit due to the failure of the user to deenergize the circuit after ignition has taken place and the appliance is in operation. The foregoing problem has been encountered most frequently in gas ranges wherein the energization of the circuit that ignites the burners of the range was effected by rotation of the gas valve control knob to a position somewhat beyond the position corresponding to a substantially full-open position of the valve. Since many users of gas ranges would frequently leave the control valve in its full-open position in order to obtain maximum heating, the ignition circuit remained on with the result that premature failure of one or more of the components of the circuit occurred.

In order to overcome this problem, various solutions have been proposed for rotating the gas control valve away from its ignition circuit actuating position, after ignition has occurred, by means of some type of spring connected to the rotatable valve member of the valve. Examples of gas control valves utilizing springs for deenergizing an associated electrical ignition circuit are disclosed in the Clausing U.S. Pat. No. 1,700,559, Owen U.S. Pat. No. 1,173,851 and Pacifico U.S. Pat. No. 2,596,505.

While the springs disclosed in the aforementioned patents generally accomplished their intended purpose, they were not entirely satisfactory and/or reliable for various reasons, and were not suited for use in modern, combination gas control valve-electrical switch assemblies such as is disclosed in the Stevens et al U.S. Pat. No. 4,123,633.

SUMMARY OF THE INVENTION

Briefly described, the present invention contemplates a leaf-type, turn-back spring for use with a combination gas flow control valve-electrical switch assembly of the type employed to control the flow of gas to the burner of a gas appliance and to energize an associated electrical ignition circuit in the appliance for igniting the burner. As will be described in greater detail hereinafter, the turn-back spring of the present invention is adapted to be mounted on the body of the gas control valve of the assembly so as to engage an abutment on the rotatable valve member and to offer increasing resistance as the valve member is rotated beyond a position corresponding to a substantially full-open position of the valve.

The electrical switch portion of the assembly includes an annular, rotatable operating member or bushing through which an extension or stem of the valve member extends and which is effective to close the contacts of the switch when the valve member and its stem are rotated to an ignition position somewhat beyond the full-open position of the valve. Consequently, when the valve member and its stem are rotated to the aforementioned ignition position, the contacts of the electrical switch portion of the assembly close and the turn-back spring automatically effects rotation of the valve member back to its substantially full-open position whenever a user releases the operating knob on the outer end of the valve stem. Consequently, the possibility of premature failure of one or more of the components of the electrical ignition circuit of the appliance, due to unintended, continuous energization of the circuit, is eliminated.

DESCRIPTION OF THE PREFERRED EMBODIMENTS

Figures 1, 2, 3:
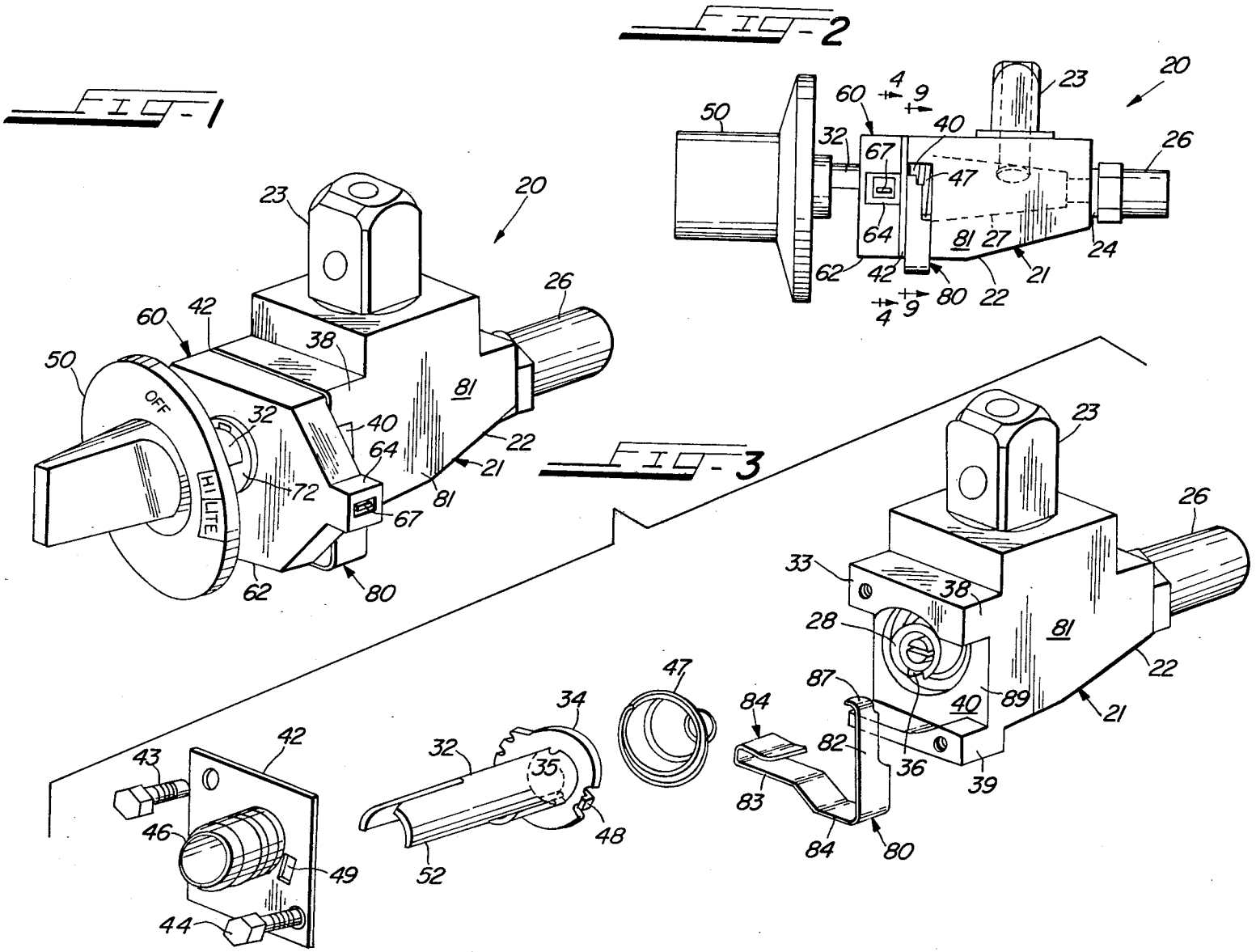
FIG. 1 is a perspective view of a valve-switch assembly for a gas appliance, the latter including a turn-back spring embodying the features of the present invention for automatically deenergizing the electrical ignition circuit of the appliance.
FIG. 2 is a side elevational view of the valve-switch assembly illustrated in FIG. 1.
FIG. 3 is an exploded perspective view of the gas control valve portion of the assembly illustrated in FIG. 1.
Figure 6:
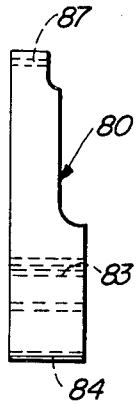
FIGS. 6 and 7 are side and front elevational views, respectively, of the turn-back spring employed in the valve-switch assembly illustrated in FIGS. 1, 2 and 3.
Figure 7:
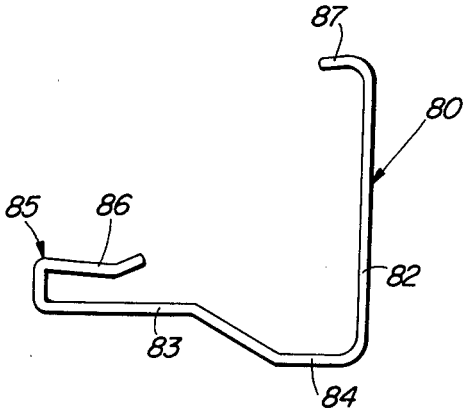
Figure 8:
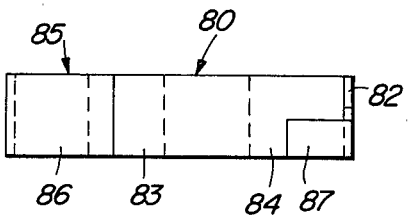
FIG. 8 is a top plan view of the spring illustrated in FIGS. 6 and 7.

In FIGS. 1 and 2, a valve-switch assembly for controlling the energization of an associated electrical ignition circuit (not shown) for a gas appliance and for controlling the flow of gas thereto, is illustrated and indicated generally at 20. In the description which follows, it will be assumed that a plurality of the valve-switch assemblies 20 are employed in a gas range and are connected to the respective burners and oven of the range. It will also be assumed that each valve-switch assembly 20 serves to cause the electrical ignition circuit of the range to establish a spark across a pair of electrodes adjacent to a particular burner of the range so as to ignite the flow of gas discharging from this burner.

Each valve-switch assembly 20 thus comprises a valve means, indicated generally at 21, which, in the present instance, includes a one-piece valve body 22 having an integral, upwardly extending inlet boss 23 and an axially extending outlet boss 24 (FIG. 2) onto which an outlet fitting 26 is threaded. Passages (not shown) in the valve body 22 connect the inlet boss 23 with the outlet boss 24 and fitting 26. A valve member, illustrated in broken lines and indicated at 27 in FIG. 2, is rotatably mounted in the body 22 so as to intersect the internal passages in the body and control fluid flow through the valve. One end of the valve member is indicated at 28 in FIG. 3.

In order to permit a user to effect rotation of the valve member in the valve body 22 and thus control the flow of gas flowing out of the outlet fitting 26, an extension or stem 32 extends outwardly from one end, indicated at 33, of the valve body 22 with the axis of the stem 32 substantially coaxial with that of the valve member 27. In order to establish a drive connection between the stem 32 and valve member 27, a drive washer 34 is secured to the inner end of the stem 32, and a tongue 35 (FIG. 3) on the drive washer 34 extends axially toward the valve body 22 and is received in a notch 36 in the inner end 28 of the valve member 27.

The drive washer 34 is received in a cavity 40 defined by a pair of generally rectangular, horizontally extending, vertically spaced, upper and lower flanges 38 and 39 on the end 33 of the valve body. A rectangular plate 42 is secured to the outer faces of the bosses 38 and 39 such as by screws 43 and 44, and a bushing 46 is pressed into an opening into the plate 42 to receive and journal the stem or extension 32. Thus, when the stem 32 is rotatably journaled in the bushing 46 and the plate 42 is secured to the outer end faces of the bosses 38 and 39 by the screws 43 and 44, the drive washer 34 is positioned in the cavity 40 defined by the flanges 38 and 39 and the plate 42.

In order to releasably secure the stem 32 in a position corresponding to the closed position of the valve member 27, a coil spring 47 is provided between the drive washer 34 and adjacent end 28 of the valve member 27 so as to bias the drive washer 34 toward the inner side of the plate 42 and a finger 48 on the drive washer into a receiving opening 49 in the plate 42. Thus, when the finger 48 extends into the opening 49, the stem 32, and hence the valve member 27, are locked against rotation and gas is prevented from flowing through the valve 21.

A user may easily free the valve member 27 for counterclockwise rotation to permit gas to flow through the valve 21 by applying an inward force on a knob 50 connected to the outer end, indicated at 52, the stem 32 sufficient to overcome the force of the coil spring 47 and permit the finger 48 to move out of the opening 49. The depth of the cavity 40 and the length of the notch 36 is sufficient to accommodate this amount of movement. The normal range of positions of the valve member 27 may be indicated by legend on the outer face of the knob 50 and by contrasting colors (not shown). In FIG. 1, for example, the closed position of the valve member 27 is indicated by the word "OFF" on the outer face of the knob 50, and the substantially full-open position of the valve member is indicated by the word "HI" on the outer face of the knob.

Figure 4:
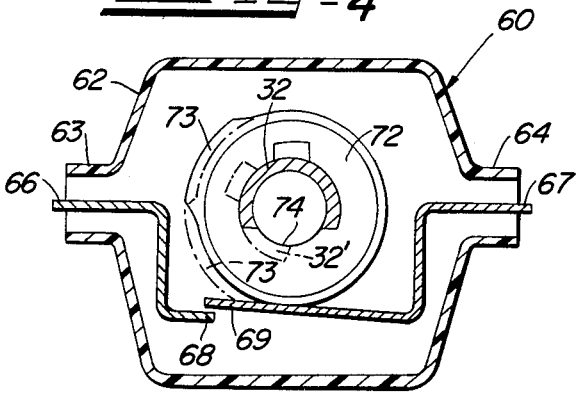
FIG. 4 is an enlarged, vertical sectional view, taken substantially along the line 4—4 of FIG. 2, and showing the parts of the electrical switch of the valve-switch assembly as they would appear when the gas flow control valve is in a closed position.
Figure 5:
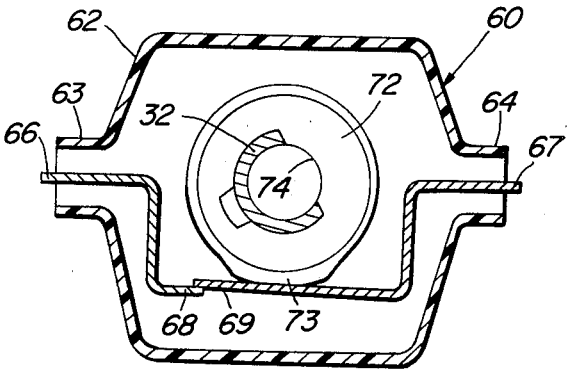
FIG. 5 is a view similar to FIG. 4 but showing the parts of the switch as they would appear when the control knob of the gas flow control valve has been rotated to a position somewhat beyond its substantially full-open position.

As heretofore mentioned, the valve-switch assembly 20 also includes electrical switch means in the form of a switch 60 (FIGS. 1 and 2) for effecting energization of the associated electrical ignition circuit of the appliance in which the assembly 20 is installed. Thus, as will be apparent from FIGS. 4 and 5 in conjunction with FIGS. 1 and 2, the switch 60 includes a generally rectangular housing 62 having a pair of hollow bosses 63 and 64 extending laterally outwardly from the respective sides thereof. Terminals, indicated at 66 and 67, of the switch 60 are centrally mounted in the bosses 63 and 64 and are respectively connected to contact means in the interior of the housing 62. Such contact means, in the present instance, is provided by a fixed, electrically conducting arm or contact 68 and a flexible, electrically conducting arm or contact 69, which is normally spaced from the arm 68 but which is shifted into engagement with the arm 68 by an operating member in the form of a non-conducting sleeve or bushing 72 that is rotatably mounted in the housing 62. To this end, the bushing 72 is provided with an enlargement or cam 73 on a portion of its outer periphery, the cam 73 being movable into engagement with the upper surface of the movable arm 69 to shift the same into engagement with the fixed arm 68, as indicated in FIG. 5, when the knob 50 is rotated to its "LITE" position.

To this end, the opening, indicated at 74, in the bushing 72 is non-circular and the outer end 52 of the stem 32 is contoured so that the stem 52 is non-rotatively engaged in the opening 74. Moreover, the arrangement is such that when the stem 32 is engaged in the opening 74 and the knob 50 is in its "OFF" position with the finger 48 of the washer 34 seated in the opening 49 in the plate 42, the cam 73 of the bushing 72 will be out of engagement with the movable arm 69, as illustrated by the full line position of the cam 73 in FIG. 4. As will be described more fully hereinafter, the relative angular positions of the cam 73 and stem 32 are such that when the knob 50 is in its flow igniting or "LITE" position, the cam 73 will have engaged and shifted the movable arm 69 into engagement with the fixed arm 68. However, when the knob 50 is in its "HI" position, the cam 73 only contacts the flexible arm 69 but does not shift it into engagement with the fixed arm 68. The latter positions of the cam 73 and stem 32 are indicated in phantom lines in FIG. 4 and identified by the reference numerals 73' and 32', respectively.

According to the present invention, the valve-switch assembly 20 includes spring means, indicated generally at 80 in FIGS. 1–3, inclusive, and 6–11, inclusive, for automatically rotating the valve member 27 and stem 32 back to its predetermined position substantially corresponding to the full-open position of the valve 21 after the stem and valve member 27 have been rotated to the aforementioned "LITE" position. The spring means 80 thus preferably comprises a generally L-shaped leaf spring which, when operatively engaged with the valve-switch assembly 20, has one leg 82 thereof extending generally vertically along the right side, indicated at 81, of the valve body 22, and the other leg thereof, indicated generally at 83, extending generally horizontally below the lower flange 39 of the valve body. The leg 83 also includes an offset or resilient portion 84.

In order to facilitate mounting of the spring 80 on the valve body 22, the outer or left end of the leg 83 thereof is provided with a clip, indicated generally at 85, for frictionally engaging a portion of the lower flange 39 of the valve body 22. The clip 85 is preferably formed integrally with the spring 82 and comprises a section 86 thereof, which is reversely bent inwardly toward the leg 82 to define the clip 85.

The upper end, indicated at 87 of the leg 82 is bent inwardly to form a hook for engaging an abutment on the valve member 27 or stem 32 when the valve member is rotated to its aforementioned predetermined position corresponding to a substantially full-open position of the valve member. Such abutment, in the present instance, preferably comprises a lug 92 on the outer periphery of the drive washer 34. To this end, the side 81 of the valve body 22 includes an opening 89, which is connected to the cavity 40 and through which the hook 87 of the spring 80 extends, the opposite side, indicated at 90 in FIGS. 9, 10 and 11, of the valve body 22 includes another opening 91, which also connects with the cavity 40 and through which the section 86 of the clip 85 extends.

Figure 9:
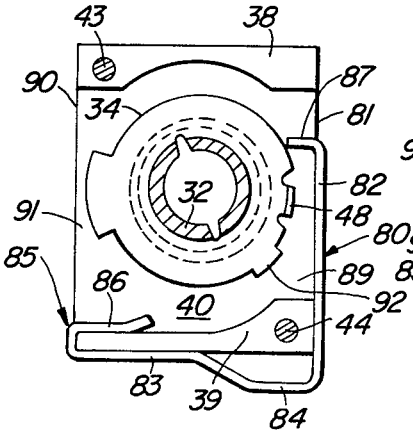
FIG. 9 is a vertical sectional view, with some parts in elevation and with others omitted for clarity, taken substantially along the line 9—9 of FIG. 2.
Figure 10:
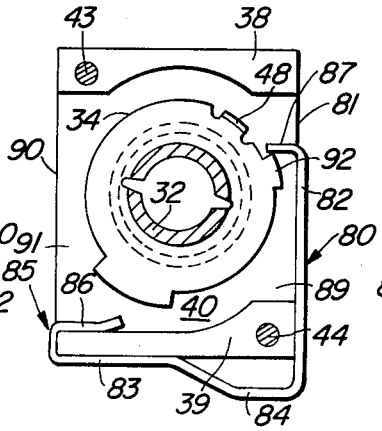
FIGS. 10 and 11 are vertical sectional views, similar to FIG. 9, but showing the parts of the assembly in different positions.
Figure 11:
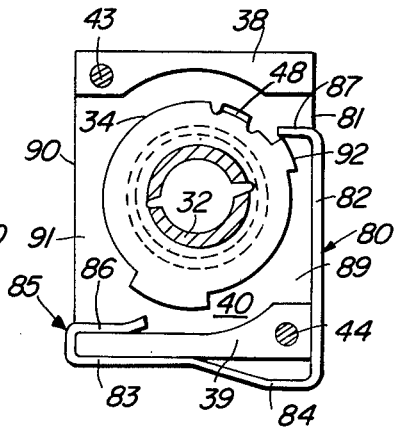

Referring now to FIGS. 9, 10 and 11 in conjunction with FIGS. 1, 2, 4 and 5, the manner in which the spring 80 operates to automatically rotate the valve member 27 of the assembly 20 from its "LITE" to its "HI" position to automatically deenergize the electrical ignition circuit of an associated gas range when the knob 50 is released by a user after the associated burner has ignited, will now be described. Assuming that a plurality of the valve-switch assemblies 20 incorporating the turn-back spring 80 have been installed in the range and that a user wishes to use one of the burners for cooking purposes, the knob 50 of the assembly 20 which controls the particular burner to be used is initially pushed inwardly to disengage the finger 48 from the opening 49 and the front plate 42. Thereafter, the user rotates the knob 50 in a counterclockwise direction as viewed in FIG. 1 until the knob is in its "HI" position. Such position corresponds to the substantially full-open position of the valve member 27. At this point, the lug 92 on the drive washer 34 just engages the hook 87 of the spring 80, as illustrated in FIG. 10, and the user feels the resistance of the spring 80. At this time, the cam 73 in the switch 60 has just engaged the movable contact 69 of the switch but has not moved the latter into engagement with the fixed contact 68. Such position of the cam is illustrated in phantom lines in FIG. 4 and indicated at 73'.

The user then applies additional torque to the knob 50 sufficient to rotate the stem 32 and drive washer 34 from the positions thereof illustrated in FIG. 10 to the positions thereof illustrated in FIG. 11. As the drive washer 34 moves from its FIG. 10 to its FIG. 11 position, the lug 92 pulls the leg 82 of the spring 80 upwardly and thus tensions the resilient portion 84 of the spring. Sometime during this incremental movement, the cam 73 of the switch 60 causes the movable arm 69 to engage the fixed contact 68 so that the ignition circuit of the appliance is energized. A spark is thus generated across electrodes adjacent to the burner to be ignited. The user continues to hold the knob 50 in its "LITE" position until the gas flowing from the burner is ignited.

When ignition occurs, the user releases the knob 50 and either leaves the knob in its "HI" position, or rotates the knob to an intermediate position to reduce the gas flow to the burner. In any event, as soon as the knob 50 is released, the tension in the resilient portion 84 of the spring 80 causes the leg 82 thereof to move downwardly to the position thereof illustrated in FIG. 10. Such movement causes the hook 87, acting through the lug 92, to rotate the drive washer 34 clockwise to the position thereof illustrated in FIG. 10. A comparable clockwise rotation of the bushing 72 of the switch 60 also occurs, which is sufficient to permit the movable arm 69 of the switch 60 to separate from the fixed arm 68 and deenergize the ignition circuit of the appliance. Consequently, the spark across the electrodes adjacent to the burner being ignited is terminated and the components of the ignition circuit are not needlessly operated.

Figure 12:
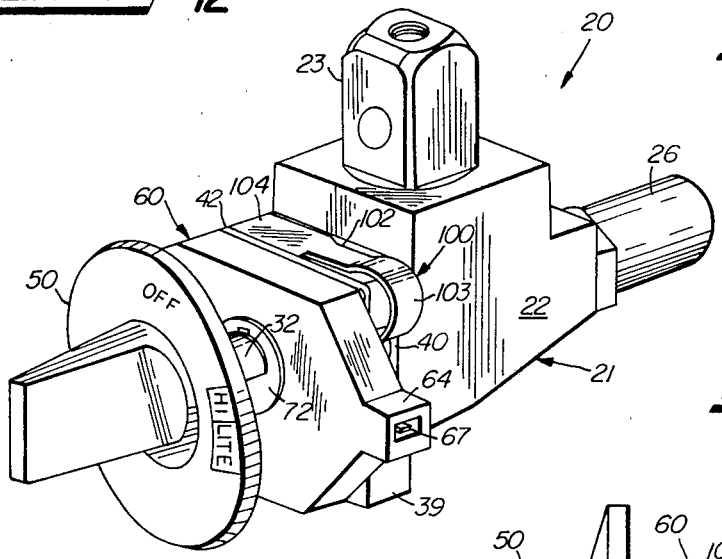
FIG. 12 is a perspective view of another valve-switch for a gas appliance and employing another turn-back spring embodying the features of the present invention for automatically deenergizing the electrical ignition circuit of the appliance.
Figure 14:
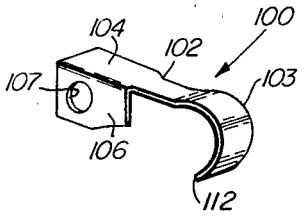
FIG. 14 is a perspective view of the turn-back spring employed in the valve-switch assembly illustrated in FIGS. 12 and 13.
Figure 13:
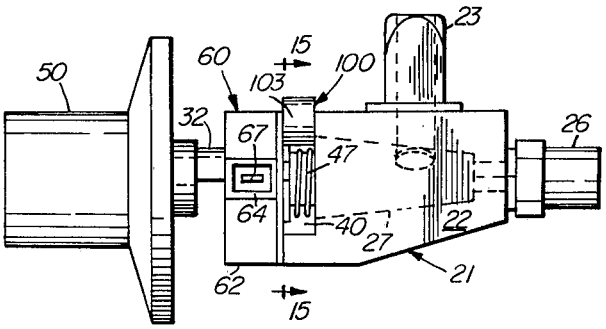
FIG. 13 is a side elevational view of the valve-switch assembly illustrated in FIG. 12.

Referring now to FIGS. 12, 13 and 14, another spring means, indicated generally at 100 and embodying the features of the present invention, is illustrated. The spring means or turn-back spring 100 is capable of performing the same functions as the spring 80. Consequently, the spring 100 will be herein described in conjunction with the valve-switch assembly 20, previously described.

As best seen in FIG. 14, the spring 100 is of the leaf type and includes an elongated portion 102 having an arcuate, resilient portion 103 at one end thereof and a flat, mounting portion 104 at the opposite end thereof. The arcuate, resilient portion 103 is reversely curved toward the mounting portion 104 and is of approximately 200° in angular duration.

The spring 100 also includes a mounting flange 106, which extends downwardly from the forward edge of the flat, mounting portion 104 and which is provided with an opening 107 therethrough for receiving a threaded fastener, such as the screw 43. Thus, when operatively mounted on the valve body 22, the flat, mounting portion 104 of the spring 100 rests on the upper surface, indicated at 108, of the boss 38 and so that the mounting flange 106 thereof engages the end face, indicated at 109, of the boss 38. The arcuate portion 103 of the spring 100 thus extends through the opening 89 in the side 81 of the valve body 22 and into the cavity 40 in the same manner as the hook end 87 of the spring 80. The manner in which the spring 100 serves to automatically deenergize the electrical ignition circuit of an associated gas range when the knob 50 of a selected valve-switch assembly 20 is released by a user after the associated burner has ignited, will now be described.

Figure 15:
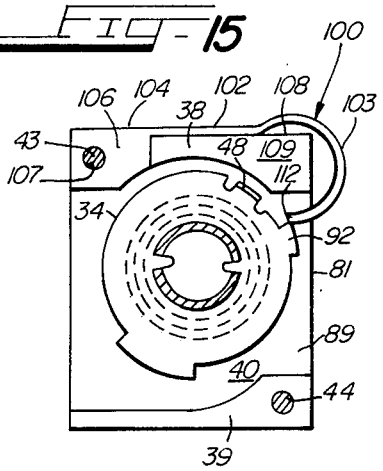
FIG. 15 is a vertical sectional view, with some parts in elevation, taken substantially along the line 15—15 of FIG. 13.

Assuming that a user of a gas range having a plurality of the valve-switch assemblies 20 incorporating a corresponding plurality of turn-back springs 100 desires to initiate a flow of gas from one of the burners of the range, and to ignite the same, he or she pushes inwardly on the knob 50 of the valve-switch assembly associated with that burner and then rotates the knob counterclockwise, as viewed in FIG. 12, until the knob is in its "HI" position. Such position corresponds to the substantially full-open position of the valve member 27. At this time, the lug 92 on the drive washer 34 will just engage the end 112 of the arcuate or resilient portion 103 of the turn-back spring 100, as illustrated in FIG. 15. At the same time, the cam 73 and stem 32 will have rotated to their broken line positions illustrated in FIG. 4 and indicated at 73' and 32'.

Figure 16:
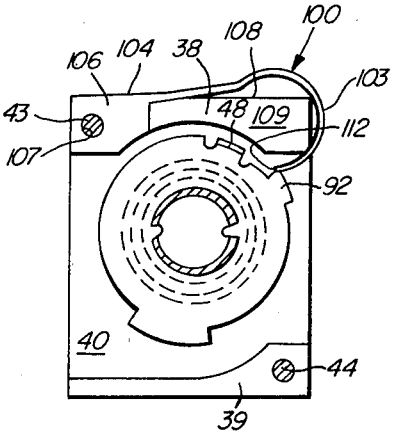
FIG. 16 is a view similar to FIG. 15 but showing the parts of the assembly in the positions they would occupy when the ignition circuit of the appliance is energized.

When the user feels the resistance of the turn-back spring 100, he or she then applies additional torque to the knob 50 sufficient to effect an additional amount of incremental, counterclockwise movement of the valve member 27 and stem 32, such as to cause the cam 73 of the switch 60 to shift the movable arm 69 into engagement with the fixed arm 68, as illustrated in FIG. 5. The position of the drive washer 34 and resilient portion 103 of the turn-back spring 100 at this time is illustrated in FIG. 16.

When ignition occurs, the user releases the knob 50 and either leaves the knob in its "HI" position, or rotates the knob to an intermediate position to reduce the gas flow to the burner. In any event, when the knob 50 is released, the force of the tensioned, resilient portion 103 of the spring 100 pushes downwardly on the lug 92 and effects clockwise rotation of the drive washer 34, and hence the valve member 27 and stem 32, from the positions illustrated in FIG. 16 to the positions thereof illustrated in FIG. 15. The cam 73 of the switch 60 thus returns to its broken line position illustrated in FIG. 4 and the movable and fixed arms 69 and 68 of the switch separate. Consequently, the ignition circuit is deenergized and the danger of premature failure of the components thereof is eliminated. The user may, of course, rotate the knob 50 after ignition has occurred to any intermediate position between the substantially fully open position of the valve 21 and its closed position.

From the foregoing description, it will now be apparent that the turn-back springs 80 and 100 of the present invention provide a simple and effective solution to the problem of possible premature failure of the components of the electrical ignition circuit of a gas appliance due to unintentional, continued operation of the circuit after the gas flow from one or more of the burners of the appliance has been ignited. Moreover, each of the turn-back springs 80 and 100 herein disclosed provides a shock absorbing action which reduces the possibility of damage to the parts of their associated valve-switch assemblies 20 in the event that an attempt is made to forcefully rotate the control knob 50 of the respective assemblies to positions beyond their "LITE" positions. In addition, the location and mounting of the turn-back springs 80 and 100 on the valve bodies 22 is such as to minimize the lost motion between the components of valve-switch assemblies 20, thereby substantially reducing the amounts of rotation of the control knobs 50 of the assemblies in order to energize the ignition circuit.

It should be understood that, while the turn-back springs 80 and 100 of the present invention have been herein illustrated and described as being mounted on the bosses 38 and 39 of the valve bodies 22, these springs could be mounted in other locations on the valve-switch assemblies 20, such as in front of or behind the rectangular face plate 42. Moreover, extension or compression springs, located in front of or behind the face plate 42, could be employed instead of the leaf-type springs 80 and 100, or rod-type, torsion springs could also be utilized.

It will further be understood that while the turn-back springs 80 and 100 have been herein illustrated and described in conjunction with valve-switch assemblies that do not include any indexing structures or "click" stops between the "OFF" and "HI" positions of the valves, the turn-back springs could also be used to advantage in valve assemblies which employ such structures to identify intermediate rotated positions of the valve members.

It should likewise be understood that the turn-back springs 80 and 100 of the present invention could be employed in valve-switch assemblies utilized to ignite and control the flow of gas supplied to appliances other than household gas ranges, such as clothes dryers, barbeque grills, and recreational vehicle gas ranges. Moreover, the turn-back springs 80 and 100 could be used with valve-switch assemblies adapted for use with combustible fluids other than gas.

While one or more embodiments of the invention have been herein illustrated and described, it will be understood that modifications and variations thereof may be developed which do not depart from the spirit of the invention and the scope of the appended claims.

I claim:

1. In a valve-switch assembly for igniting and controlling the flow of gas to a gas appliance or the like, said valve means including a valve body having an inlet, an outlet, and a valve member rotatably mounted in said body, said valve member being adapted to be manually rotated in opposite directions by a user between a position wherein said valve means is closed and a predetermined position wherein said valve means is substantially fully open, said valve member also having an abutment rotatable therewith, said assembly also including electrical switch means disposed at one end of said valve body and having an operating member rotatable with said valve member, and said electrical switch means also having contact means adapted to be connected to an associated electrical circuit for energizing said circuit and igniting gas being supplied to said gas appliance, the improvement comprising spring means carried by said valve-switch assembly and having an end adapted to be engaged by said abutment when said operating member and valve member are rotated to said predetermined, substantially fully open position, said operating member and valve member also being rotatable to an ignition position beyond said predetermined, substantially fully open position whereat the contacts of said switch are closed, said associated electric circuit is energized, and the flow of gas to said appliance is ignited, said spring means also having a resilient portion adapted to resist rotation of said operating member and said valve member beyond said predetermined, substantially fully open position, and said resilient portion of said spring means also being adapted to automatically rotate said operating member and said valve member from said ignition position to said predetermined, substantially fully open position whenever the torque applied to said valve member by a user to overcome the force of the resilient portion of said spring means is released.

2. The improvement of claim 1, in which said abutment comprises a lug on said valve member.

3. The improvement of claim 2, in which said valve member includes a stem extending outwardly from said one end of said valve body, a drive washer is carried on the inner end of said stem, and said lug is carried on the outer periphery of said drive washer.

4. The improvement of claim 3, in which a cavity is formed in said one end of said valve body, said drive washer is disposed in said cavity, an opening is provided in at least one side of said valve body and connected to said cavity, and said end of said spring means extends through said opening and into said cavity for engaging said lug.

5. The improvement of claim 4, in which said spring means has a mounting portion spaced from said resilient portion and adapted to fixedly engage said valve body.

6. The improvement of claim 5, in which another opening is provided in the side of said valve body opposite from said one opening, said cavity and said openings are defined in part by a pair of horizontally extending, vertically spaced flanges on said one end of said valve body, said spring means is generally L-shaped and arranged with one leg extending vertically along said one side of said valve body and with the other leg thereof extending horizontally under the lower flange of said valve body, and said mounting portion comprises a clip at the outer end of said other leg of said spring means and frictionally engaging said lower flange.

7. The improvement of claim 6, in which said clip comprises a reversely bent section of the outer end of said other leg, said reversely bent section extending into said other opening in said valve body.

8. The improvement of claim 6, in which the upper end of the vertically extending leg of said spring means includes a hook for engaging said lug.

9. The improvement of claim 4, in which said spring means comprises an elongated leaf spring having said resilient portion at one end thereof and said mounting portion at the other end thereof, said mounting portion includes a flat section adapted to engage a flat, upper surface portion of said valve body overlying said cavity, said resilient portion is reversely curved toward said mounting portion, and said mounting portion is adapted to be secured to said valve body with the remote end of said resilient portion extending through said opening in the side wall of said valve body for engaging the lug on said drive washer.

10. The improvement of claim 9, in which said flat mounting portion has a flange extending downwardly from one edge thereof, said flange has an opening therein, and said opening is adapted to receive a fastener for securing said mounting portion to said valve body.

* * * * *